US005259664A

United States Patent [19]

Cottle

[11] Patent Number: 5,259,664

[45] Date of Patent: Nov. 9, 1993

[54] EXTENDABLE/RETRACTABLE FOOT/LEG REST FOR A WHEELCHAIR

[76] Inventor: David Cottle, P.O. Box 243, Hondo, Tex. 78861

[21] Appl. No.: 868,557

[22] Filed: Apr. 14, 1992

[51] Int. Cl.[5] ..... A47C 7/50

[52] U.S. Cl. ..... 297/423.26; 297/423.38; 403/109

[58] Field of Search ..... 248/285; 403/109, 377; 297/433, 434, 435, 437; 5/624

[56] References Cited

U.S. PATENT DOCUMENTS

| | | | |
|---|---|---|---|
| 403,318 | 5/1889 | Arnold . | |
| 516,493 | 3/1894 | Knight . | |
| 945,928 | 1/1910 | Fowler et al. . | |
| 2,503,942 | 4/1950 | Engelberg et al. . | |
| 3,792,885 | 2/1974 | Giardina et al. | 292/259 |
| 3,794,381 | 2/1974 | Caldemeyer | 297/435 |
| 4,754,987 | 7/1988 | Williams . | |
| 4,981,305 | 1/1991 | Lockard et al. | 297/433 |
| 5,004,203 | 4/1991 | Fabius | 403/109 |
| 5,033,793 | 7/1991 | Quintile | 297/433 |

*Primary Examiner*—Peter M. Cuomo
*Assistant Examiner*—Michael J. Milano
*Attorney, Agent, or Firm*—Gunn, Lee & Miller

[57] ABSTRACT

Applicant's invention is an improved design for an extendable foot/leg rest assembly for use with a wheelchair. The design utilizes an internal rack and pinion assembly for extending and retracting the telescopic tubing which supports the foot platform against which a user's foot rests. Applicant's design obviates the need for externally protruding pivot arms with their associated safety, weight, and appearance problems.

3 Claims, 2 Drawing Sheets

EXTENDABLE/RETRACTABLE FOOT/LEG REST FOR A WHEELCHAIR

BACKGROUND OF THE INVENTION

1. Field of The Invention

Applicant's invention relates to wheelchairs and more particularly to adjustable leg rests for wheelchairs.

2. Background Information

It is well known that the human leg's effective length changes depending on the degree to which the leg is bent at the knee. As the knee is flexed, the overall length of the leg decreases. Conversely, as the knee is extended, the overall length increases.

These facts are reflected in the design of certain wheelchair leg/foot rests—those which may be raised and lowered to achieve much the same effect as that of the leg rest of a recliner. Such leg/foot rests extend in length as they are raised to accommodate the increased length of the user's leg. As the leg/foot rests are lowered to allow the user a standard, upright seating position, the leg/foot rests contract in length.

Currently, the state of the art extendable foot/leg rests employ external pivot arms to effect their extension and contraction. Referring to FIG. 1 of the drawings included herewith, a general representation of a current state of the art foot/leg rest 100 is depicted with the foot/leg rest 100 in the lowered position. Tube 102 attaches to the wheelchair (not shown) in a horizontal orientation. The distal end of tube 102 is formed as a gear member 104. The gear member is rotatably attached to bracket 106. Also rotatably attached to bracket 106 is a second gear 108 which is positioned for engagement with gear member 104. Rigidly attached to gear 104 at its proximal end is a first pivot arm 110. Pivotally attached at its proximal end to the distal end of first pivot arm 110 is a second pivot arm 112. The distal end of the second pivot arm 112 is pivotally attached to tube 114. The distal end of tube 114 exhibits a foot rest 116 against which a user's foot rests. Most often, the foot rest 116 is hingedly attached to tube 114 for allowing the foot rest 116 to be moved for facilitating a user's entering and leaving the wheelchair. The proximal end of tube 114 is telescopically received into tube 118 which is rigidly affixed (by welding) to bracket 106.

From the perspective shown in FIG. 1, the action of the foot/leg rest 100 may be understood as follows: As the lower portion of the foot/leg rest 100 is to be raised (that portion including tubes 118 and 114 and bracket 106), it is moved in a clockwise direction. As bracket 106 moves in relation to the stationary tube 102, the resulting interaction between gears 104 and 108 causes the first pivot arm 110 to likewise move in a clockwise rotation. The resulting interaction respectively between first pivot arm 110 and second pivot arm 112 and second pivot arm 112 and tube 114 causes tube 114 to telescopically extend from tube 118.

As the foot/leg rest 100 is to be lowered, the process is simply reversed with tube 114 telescopically retracting into tube 118.

Difficulties arise from the design of the current state of the art extendable/retractable foot/leg rest. The pivot arms, acting as they do in a scissor-like manner, pose potential safety hazards for users. The pivot arms are also known to snag a user's clothing during use.

Finally, the pivot arm assembly is quite weighty and is not particularly attractive from an aesthetic standpoint.

SUMMARY OF THE INVENTION

It is an object of the present invention to provide a novel design for an extendable foot/leg rest for a wheelchair which design obviates the need for pivot arms situated external to the telescopic tubes of the foot/leg rest.

It is another object of the present invention to provide a novel design for an extendable foot/leg rest for a wheel-chair which design lessens the safety hazards associated with prior art designs.

It is another object of the present invention to provide a novel design for an extendable foot/leg rest for a wheel-chair which design provides a less weighty foot/leg rest.

It is another object of the present invention to provide a novel design for an extendable foot/leg rest for a wheel-chair, which design, while equally effective, is more aesthetically attractive.

In satisfaction of these and related objectives, Applicant's present invention provides a design for a novel, extendable foot/leg rest which employs a dual rack and pinion-like assembly for effecting the extension and retraction of the foot/leg rest. The dual rack and pinion assembly is situated wholly within the telescopic tubes of the foot/leg rest thereby obviating the need for externally situated pivot arms as is found in the prior art.

As a result of the absence of large, externally situated pivot arms, Applicant's design for an extendable foot/leg rest provides a rest which is safer, less weighty and is more aesthetically pleasing.

DETAILED DESCRIPTION OF THE PREFERRED EMBODIMENT

Figure 1:
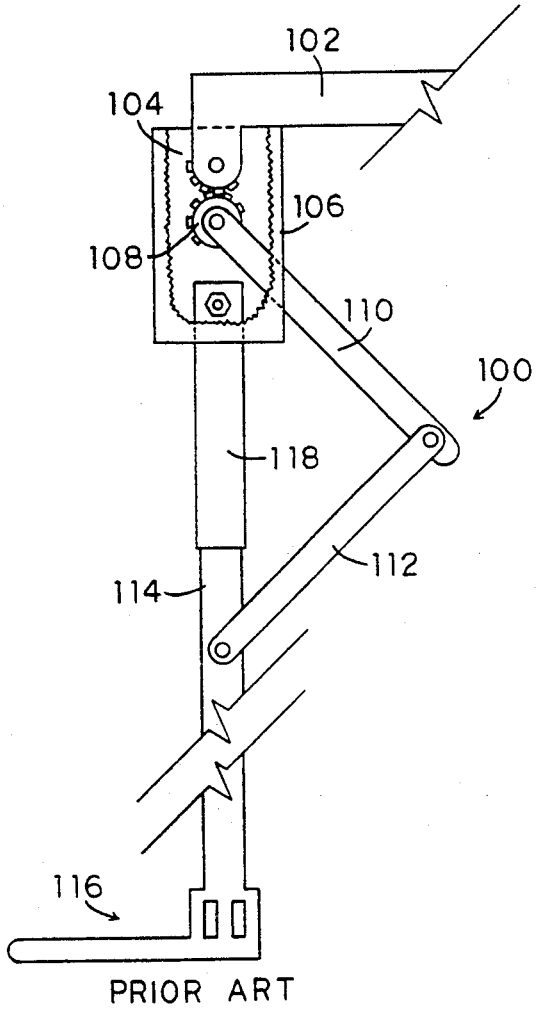
FIG. 1 is an elevational depiction of the relevant operable components of a foot/leg rest of the prior art which rest includes externally situated pivot arms.
Figure 2:
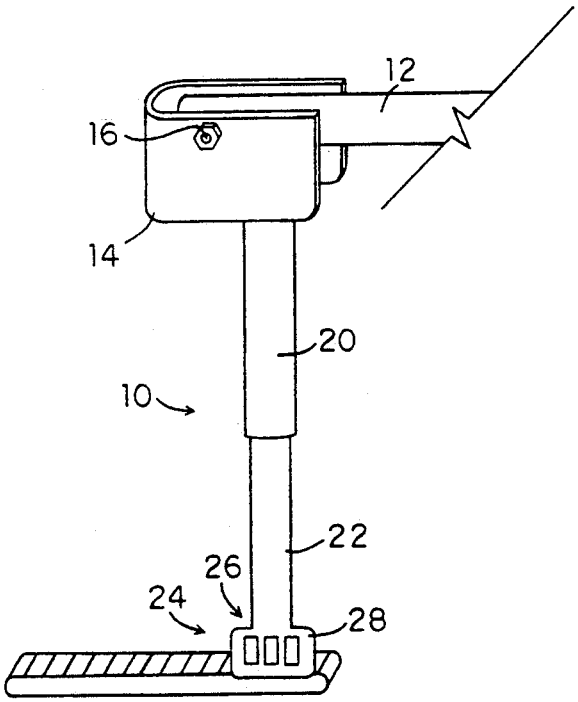
FIG. 2 is a perspective view of the preferred embodiment of Applicant's extendable foot/leg rest.

Referring to FIG. 2, depicted is a preferred embodiment of Applicant's extendable foot/leg rest for a wheelchair, identified by the reference numeral 10. Foot/leg rest 10 includes a tube 12 which attaches to a wheelchair frame (not shown in the drawings) by way of prior art means of no concern or relevance to this specification.

Figure 3:
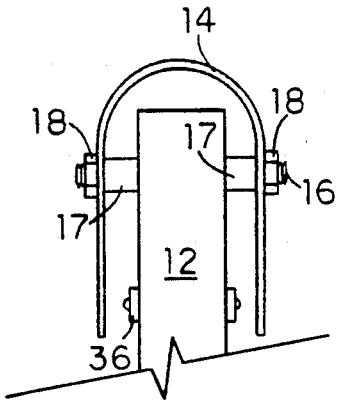
FIG. 3 is a top plan view of the preferred embodiment.

Referring jointly to FIGS. 2 and 3, tube 12 is pivotally attached to bracket 14. A stud 16, which is threaded on both ends, extends first through a first side of bracket 14, then through a first pair of washers 16, through tube 12, through a second pair of washers 16 and finally through the second side of bracket 14. Nuts 18 secure stud 16 in place.

Referring again principally to FIG. 2, foot/leg rest 10 further includes an outer telescopic tube 20 which is rigidly attached to bracket 14. If manufacturing concerns so dictate, bracket 14 can, alternatively, be an integrally forged portion of tube 20. Inner telescopic tube 22 is telescopically received within tube 20. A foot platform 24 is attached to the distal end 26 of tube 22 by way of hinge assembly 28.

Figure 4:
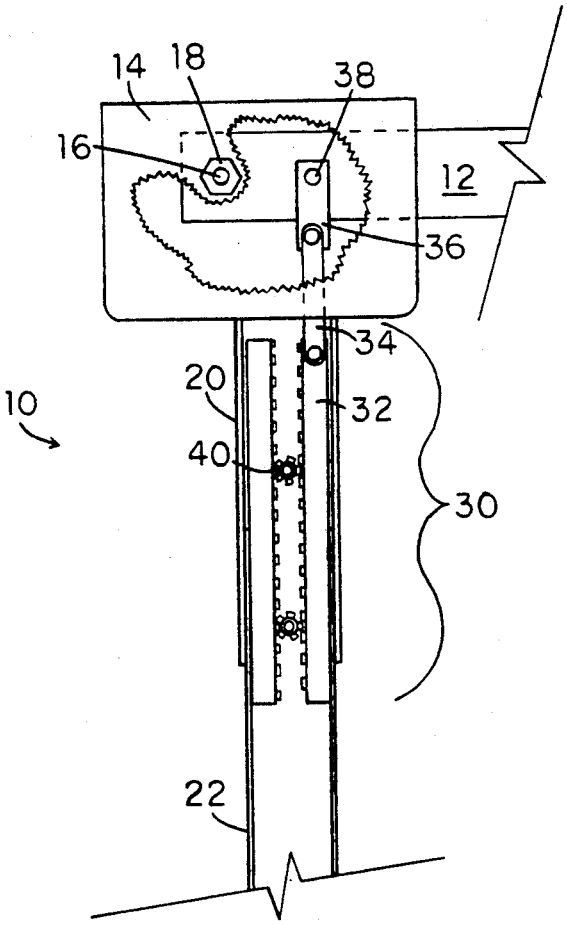
FIG. 4 is a sagittal cross sectional view of the portion of the preferred embodiment which includes the mechanical components responsible for effecting the extension and retraction of a foot/leg rest of Applicant's design.

Referring principally to FIG. 4, a dual rack and pinion assembly 30 effects the extension and retraction of inner telescopic tube 22 relative to outer telescopic tube 20. First rack 32 of the assembly 30 is pivotally attached to tube 12 by way of an intervening pivot arm 34 and yoke 36. The yoke 36 is (as more adequately shown in FIG. 3) pivotally attached on either side of tube 12 by suitable rivets 38. The pivot arm 34 is pivotally attached at its first end to the yoke 36 by a rivet and at its second end to the proximal end of the first rack 32.

Two pinions 40 are rotatably mounted within outer telescopic tube 20 by way of axles (not separately depicted in the drawings) which extend through and are rigidly attached to outer telescopic tube 20. Pinions 40 exhibit geared annular surfaces configured for appropriate geared interaction with first rack 32 and second rack 42 (to be described in more detail hereinafter).

First rack 32 is sized and shaped such that it is maintained in the desired position and orientation relative to pinions 40 by the interior contour of the inner telescopic tube 22. In other words, in the preferred embodiment, rack 32 is in cross section perpendicular to its long axis, essentially of a half-moon shape. Rack 32 is directly engaged only with the pivot arm 34 and the pinions 40 and is otherwise freely suspended within the bounds of telescopic tubes 20 and 22.

A second rack 42, of size and shape similar to that of first rack 40, is rigidly attached to inner telescopic tube 22. Second rack 42 must be attached to inner telescopic tube 22 in such a position whereby the foot platform 24 is properly oriented relative to the remainder of the foot/leg rest 10 when second rack 42 is properly engaged with pinions 40 as depicted in FIG. 4.

An examination of FIG. 4 will reveal the operation of Applicant's preferred embodiment. The foot/leg rest 10 is depicted in the up position. To move the foot/leg rest 10 to its raised position, bracket 14, outer telescopic tube 20 and inner telescopic tube 22 are pivoted as a unit in a clockwise direction which tube 12 (rigidly attached to the wheelchair frame) remains in a stationary position.

During this movement, the proximal end of first rack 32 is maintained at a constant distance from tube 12 through its attachment thereto through pivot arm 34 and yoke 36. Accordingly, first rack 32 is, relative to telescopic tubes 20 and 22, drawn toward tube 12 in a direction away from the foot platform 24. This movement of first rack 32 effects a counter-clockwise rotation of pinions 40. This rotation of pinions 40, in turn, effects a linear movement of second rack 42 in a direction opposite to that of first rack 32. By virtue of the rigid attachment of second rack 42 to inner telescopic tube 22, this movement of second rack 42 effects an extension of inner telescopic tube 22 relative to outer telescopic tube 20 with the result that the overall length of the foot/leg rest 10 increases.

As the foot/leg rest 10 is moved to its lowered position, a compressive force is applied between the proximal end of first rack 32 and tube 12 as transmitted through the pivot arm 34 and yoke 36. This compressive force effects a linear movement of first rack 32 in the direction of the foot platform 24. This movement of first rack 32 effects a clockwise rotation of pinions 40 with a resulting movement of second rack 42 in a direction opposite from the foot platform 24. The inner telescopic tube 22 is, accordingly, drawn inward such that the overall length of the foot/leg rest 10 is reduced.

It should be noted that the drawings herein are not intended to be to scale. The dimensions of the racks 32 and 42 relative to the tubes 20 and 22, for example, will vary in practice according to the overall dimensions and intended range of motion for the foot/leg rest 10.

Although the invention has been described with reference to specific embodiments, this description is not meant to be construed in a limited sense. Various modifications of the disclosed embodiments, as well as alternative embodiments of the inventions, will become apparent to persons skilled in the art upon reference to the description of the invention. It is, therefore, contemplated that the appended claims will cover such modifications that fall within the scope of the invention.

I claim:

1. A foot/leg rest for a wheelchair comprising:

a telescopic leg rest member having a proximal leg rest end and a distal leg rest end;

a chair mounting member having a proximal mounting member end and a distal mounting member end, said chair mounting member being pivotally attached at its said distal mounting member end to said proximal leg rest end;

a dual rack and pinion assembly situated within said telescopic leg rest member and being operably attached to said chair mounting member and to said telescopic leg rest member whereby pivoting said telescopic leg rest member in a first direction relative to said chair mounting member actuates dual rack and pinion assembly to increase the overall length of said telescopic leg rest assembly and whereby pivoting said telescopic leg rest assembly is a second direction relative to said chair mounting member actuates said dual rack and pinion assembly to decrease the overall length of said telescopic leg rest assembly.

2. A foot/leg rest comprising:

a first telescopic tube having a proximal first tube end and a distal first tube end, said first telescopic tube being attached at its said proximal first tube end to a distal mounting tube end of a chair mounting tube, said chair mounting tube for attaching said foot/leg rest to a chair;

a second telescopic tube having a proximal second tube end telescopically received within said distal first tube end and a distal second tube end to which is attached a foot platform;

a first rack having a proximal first rack end which is attached to said chair mounting tube near said distal mounting tube end, said first rack being in geared engagement with a pinion which is rotatably carried within said first telescopic tube;

a second rack having a distal second rack end rigidly attached to an interior surface of said second telescopic tube, said second rack being in geared engagement with said pinion on a side of said pinion opposite that where said first rack engages said pinion.

3. A foot/leg rest comprising:

an outer telescopic tube having a proximal outer tube end and a distal outer tube end;

an inner telescopic tube having a proximal inner tube end and a distal inner tube end, said proximal inner tube end being telescopically received within said outer tube at said distal outer tube end;

a chair mounting member having a distal chair mounting member end and a proximal chair mounting member end, said chair mounting member being pivotally attached at said distal chair mounting member end to said outer telescopic tube at said proximal outer tube end;

a first rack having a proximal first rack end;

a second rack having a distal second rack end; and a pinion with gears sized and shaped for geared interaction with said first rack and said second rack, said pinion being rotatably carried within said outer telescopic tube;

said first rack being pivotally attached at said proximal first rack end to said chair mounting member near said proximal chair mounting member end, said first rack further being situated within the bounds of said outer telescopic tube and in a geared engagement with said pinion on a first side of said pinion;

said second rack being rigidly attached near said distal second rack end to said inner telescopic tube, said second rack further being situated within the bounds of said inner telescopic tube and in a geared engagement with said pinion on a second side of said pinion opposite said first side of said pinion.

* * * * *